US005520257A

United States Patent [19]

Crews

[11] Patent Number: 5,520,257

[45] Date of Patent: May 28, 1996

[54] BIT WITH BALL PLUG COMPENSATOR HAVING PRESSURE RELIEF MEANS

[75] Inventor: Kay M. Crews, Arlington, Tex.

[73] Assignee: Baker Hughes Incorporated, Houston, Tex.

[21] Appl. No.: 349,332

[22] Filed: Dec. 5, 1994

[51] Int. Cl.[6] ..... E21B 10/24

[52] U.S. Cl. ..... 175/227; 175/372; 277/92; 384/93

[58] Field of Search ..... 175/227, 228, 175/327, 371, 372; 384/93; 277/92

[56] References Cited

U.S. PATENT DOCUMENTS

| | | | |
|---|---|---|---|
| 2,283,312 | 5/1942 | Boice | 308/174 |
| 2,297,192 | 9/1942 | Reed | 255/71 |
| 2,507,776 | 5/1950 | Francis | 255/71 |
| 2,519,716 | 8/1950 | Stokes | 308/198 |
| 2,814,465 | 11/1957 | Green | 255/341 |
| 3,230,020 | 1/1966 | Gilbert et al. | 308/8.2 |
| 3,251,634 | 5/1966 | Dareing | 308/8.2 |
| 3,307,645 | 3/1967 | Hildebrandt | 175/372 |
| 3,419,093 | 12/1968 | Lichte et al. | 175/228 |
| 3,675,729 | 7/1972 | Neilson | 175/228 |
| 3,762,782 | 10/1973 | Rumbarger | 308/8.2 |
| 3,845,994 | 11/1974 | Trey | 308/8.2 |
| 3,923,348 | 12/1975 | Peck | 308/8.2 |
| 4,167,980 | 9/1979 | Saxman | 175/372 X |
| 4,190,301 | 2/1980 | Lachonius et al. | 307/8.2 |
| 4,199,856 | 4/1980 | Farrow et al. | 29/454 |
| 4,258,806 | 3/1981 | Kunkel et al. | 175/370 |
| 4,316,515 | 2/1982 | Pessier | 175/372 |
| 4,399,879 | 8/1983 | Liljekvist et al. | 175/372 |
| 4,509,607 | 4/1985 | Saxman et al. | 175/227 |
| 4,597,455 | 7/1986 | Walters et al. | 175/228 |
| 4,727,942 | 3/1988 | Galle et al. | 175/228 |
| 5,363,930 | 11/1994 | Hern | 175/371 X |

*Primary Examiner*—Roger J. Schoeppel
*Attorney, Agent, or Firm*—Mark D. Perdue; Robert A. Felsman

[57] ABSTRACT

A shaft boring bit has a bit body with at least one saddle member secured to the bit body. The saddle receives and supports the ends of a journal member. A cutter is mounted for rotation on the journal member and an anti-friction bearing is disposed between the cutter and the journal and secures the cutter on the journal member. Seal means are provided between the cutter and the journal member to retain lubricant in the anti-friction bearing. A bearing loading passage is formed in the journal member for loading at least a portion of the anti-friction bearing between the cutter and the journal member. A lubricant compensator assembly is removably disposed in a lubricant compensator recess formed at one end of the journal. The lubricant compensator is in fluid communication with the anti-friction bearing and includes a rigid ball plug member, which obstructs the bearing loading passage and abuts the portion of the anti-friction bearing to retain the bearing between the cutter and journal. A resilient diaphragm is secured to an opposite end of the rigid member to enclose a lubricant reservoir partially defined in the ball plug. The diaphragm is in fluid communication with the exterior of the journal bearing and equalizes a pressure differential across the seal means.

19 Claims, 4 Drawing Sheets

BIT WITH BALL PLUG COMPENSATOR HAVING PRESSURE RELIEF MEANS

BACKGROUND OF THE INVENTION

1. Field of the Invention

The present invention relates generally to lubricant compensator systems for earth-boring bits. More particularly, the present invention relates to lubricant compensator systems for earth-boring bits of the shaft-boring variety.

2. Background Information

Earth-penetrating tools are divided into two broad categories, those designed to drill deep, relatively small diameter boreholes, and those designed to drill shallow, large diameter boreholes. Earth-boring bits with rolling cutters mounted on cantilevered bearing shafts often are called "rock bits" and are employed in drilling relatively small diameter boreholes for the recovery of petroleum or other hydrocarbons, or to tap geothermal energy sources. The nature of such drilling operations is that the operations are continued until bit life is nearly or completely expended. These rock bits, when used in mining operations such as the drilling of blast holes, generally are not recovered from the borehole until the bit is effectively destroyed. To extend the life of rock bits, many are provided with lubrication systems that include a pressure compensator to limit the pressure differential existing between the lubricant and the hydrostatic pressure in the borehole resulting from the presence of drilling fluid in the borehole.

In addition to pressure exerted on the bit by drilling fluids, temperatures increase in the lubricant as the bit is exposed to geothermal temperatures and to frictional heat build-up caused during rotation of the bit. These temperature increases cause an increase in the internal pressure of the lubricant, which causes the lubricant to expand. The increase in the internal pressure of the lubricant may also cause the lubricant to "crack" or emit gaseous hydrocarbons. If an earth-boring bit is of the type having positive seals between the cutters and bearing shafts on which the cutters rotate, the internal pressure build-up can be great enough to damage either the pressure compensator diaphragm or the seal between one of the cutters and its bearing shaft. A conventional practice in the rock bit field to avoid seal or diaphragm damage is to provide a pressure-relief valve in the lubricant reservoir. Such a pressure-relief valve permits release of lubricant upon the internal pressure of the lubricant exceeding a predetermined maximum.

Another type of earth-boring bit employs a plurality of rolling cutters, usually in excess of three, arranged to drill relatively large diameter boreholes for mining applications. These bits are used for shaft boring, which results in large-diameter boreholes or shafts. In shaft boring operations, the bit is secured directly to a drilling machine and is rotated and pushed through formation material to bore a shaft. Drilling fluid commonly is used and exerts hydrostatic pressure on the bit, while frictional heat build-up and geothermal temperatures increase the temperature in the lubricant.

Unlike rock bits, it is not a particularly common practice to provide lubricant compensation systems in shaft-boring bits. This is because shaft-boring bits are recovered from shallow shafts with substantial operational life remaining. After each recovery, lubricant can be replenished and bearings and seals repaired or replaced easily. However, these routine maintenance operations are inconvenient and increase expense. Additionally, in drilling deep or long shafts, the operational life of the shaft-boring bit may be expended before recovery, rendering it advantageous to extend that life as much as possible.

U.S. Pat. No. 3,419,093, Dec. 31, 1968 to Lichte et al. discloses a cutter assembly for a shaft-boring bit in which the cutter assembly is provided with a longitudinal bore. A lubricant reservoir is defined in the journal of the cutter circumferentially surrounding the bore. An annular flexible member encircles the longitudinal bore and serves to enclose the lubricant reservoir formed in the journal. The annular flexible member is exposed to hydrostatic pressure through the longitudinal bore during drilling operation and thus serves as a lubricant compensator. However, the displacement of the annular member is limited, thus limiting its ability to compensate for pressure imbalances, and no pressure-relief mechanism is provided.

Commonly assigned U.S. patent application Ser. No. 08/137,651, now U.S. Pat. No. 5,363,930, Nov. 15, 1994, to Hern discloses a lubricant compensator system for raise- or-shaft-boring bits that employs two resilient diaphragms, one of which is in fluid communication with the exterior of the bit and compensates for hydrostatic pressure. The other diaphragm compensates for increases in internal pressure of the lubricant.

U.S. Pat. No. 4,597,455, Jul. 1, 1986 to Walters et al. discloses a rock bit lubrication system in which lubricant compensator assemblies are provided in the cantilevered bearing shaft of a rolling cutter rock bit having three cutters. Provision of the compensator assembly in the bearing shaft of a rock bit is not practical due to the dimensional constraints of the bearing shaft because the lubricant reservoir is reduced in volume and the removal of material from the bearing shaft required to mount the lubricant compensator assembly can drastically weaken the bearing shaft, leading to premature bit failure.

A need exists, therefore, for a shaft-boring bit having cutters with lubricant compensators that make efficient use of space within the cutter assembly and that are provided with a pressure-relief means to avoid damage to cutter seal member resulting from internal pressure build-up in the lubricant.

SUMMARY OF THE INVENTION

It is a general object of the present invention to provide an improved earth-boring bit of the shaft boring variety.

This and other objects of the present invention are achieved by providing a shaft boring bit having a bit body with at least one saddle member secured to the bit body. The saddle receives and supports the ends of a journal member. A cutter is mounted for rotation on the journal member and an anti-friction bearing is disposed between the cutter and the journal and secures the cutter on the journal member. Seal means are provided between the cutter and the journal member to retain lubricant in the anti-friction bearing. A bearing loading passage is formed in the journal member for loading at least a portion of the anti-friction bearing between the cutter and the journal member. A lubricant compensator assembly is removably disposed in a lubricant compensator recess formed at one end of the journal. The lubricant compensator is in fluid communication with the anti-friction bearing and includes a rigid ball plug member, which obstructs the bearing loading passage and abuts the portion of the anti-friction bearing to retain the bearing between the cutter and journal. A resilient diaphragm is secured to an opposite end of the rigid member to enclose a lubricant reservoir partially defined in the ball plug. The diaphragm is in fluid communication with the exterior of the journal bearing and equalizes a pressure differential across the seal means.

According to the preferred embodiment of the present invention, the seal means comprises a rigid face seal at each end of the journal member and the diaphragm includes pressure-relief means to vent lubricant from the compensator upon pressure in the lubricant exceeding a predetermined pressure.

According to the preferred embodiment of the present invention, the anti-friction bearing includes a roller bearing element and a spherical element, the spherical element being loaded through the bearing loaded passage and retained there by the lubricant compensator.

According to the preferred embodiment of the present invention, an external flange is formed on the cup-shaped diaphragm and a rigid compensator cap engages the flange of the diaphragm and the ball plug to secure the diaphragm in the compensator recess. The cap is perforated to expose the diaphragm to the exterior of the journal member.

Other objects, features, and advantages of the present invention will become apparent with reference to the detailed description which follows.

DESCRIPTION OF THE PREFERRED EMBODIMENT

Figure 1:
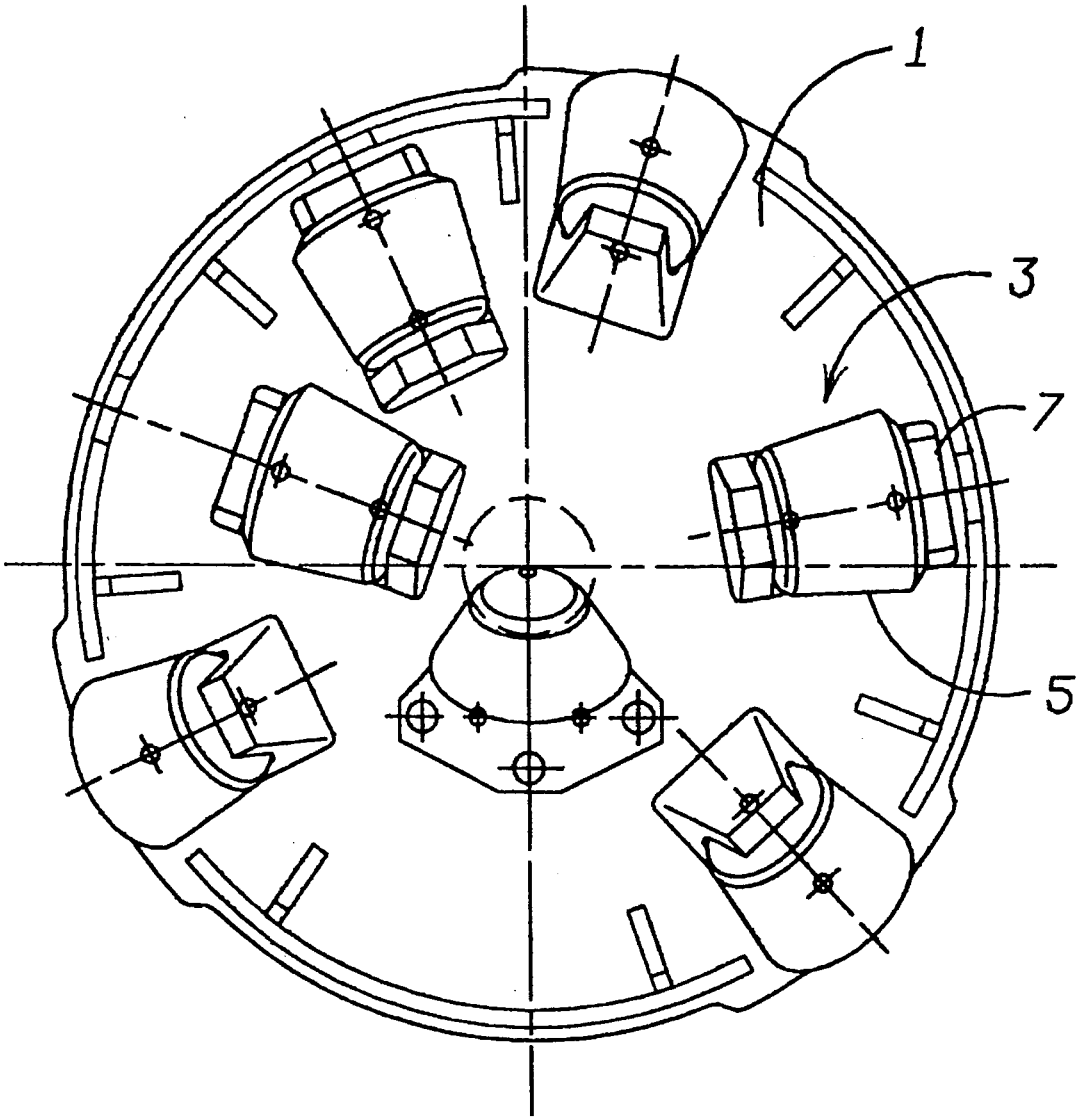
FIG. 1 is a plan view of an earth-boring bit according to the present invention.

Referring now to the Figures, and specifically to FIG. 1, a shaft-boring bit of the type contemplated by the present invention is illustrated. A bit body 1 is provided, and in operation, generally is secured directly to a drilling machine, which rotates and pushes the shaft-boring bit through formation material. A plurality of cutter assemblies 3 are disposed on bit body 1. With the exception of the center cutter assembly, each cutter assembly 3 comprises a rotatable cutter 5 that is supported by a saddle 7, which is secured to bit body 1. Cutters 5 are provided with a plurality of cutting elements, usually tungsten carbide inserts (9 in FIG. 2), or steel teeth milled from the material of cutter 5. As bit body 1 is rotated and pushed through formation material by the drilling machine, cutters 5 roll over formation material, crushing and gouging the formation material to disintegrate it. The cuttings formed by disintegration of formation material are carried away from the bit body 1 and cutter assemblies 3 by drilling fluid, which is circulated in the shaft.

Figure 2:
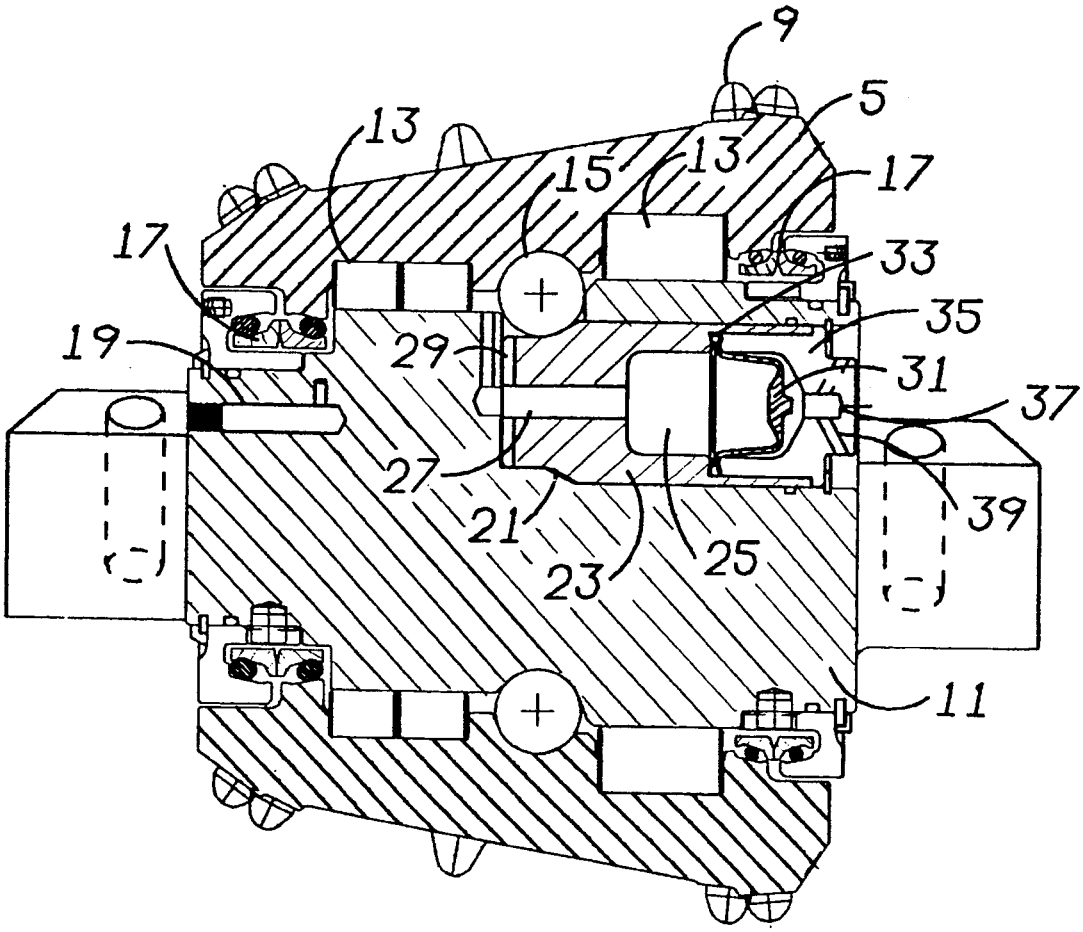
FIG. 2 is a longitudinal section view of a cutter assembly of the earth-boring bit of FIG. 1.

FIG. 2 is a longitudinal section view of a portion of cutter assembly 3 illustrated in FIG. 1. Cutter 5 is mounted for rotation on a journal member 11, which is provided with a lug on each end that is received and supported by saddle member 7 carried by bit body 1. An anti-friction bearing, including roller elements 13 and spherical elements 15, is disposed between cutter 5 and journal member 11 to facilitate rotation of cutter. A seal means in the form of a rigid face seal 17 is provided at each end of journal member 11 to retain lubricant in the anti-friction bearing and to prevent entry of foreign matter from the borehole into the bearing. The bearing is filled with lubricant through a lubricant filling passage 19.

Figure 3:
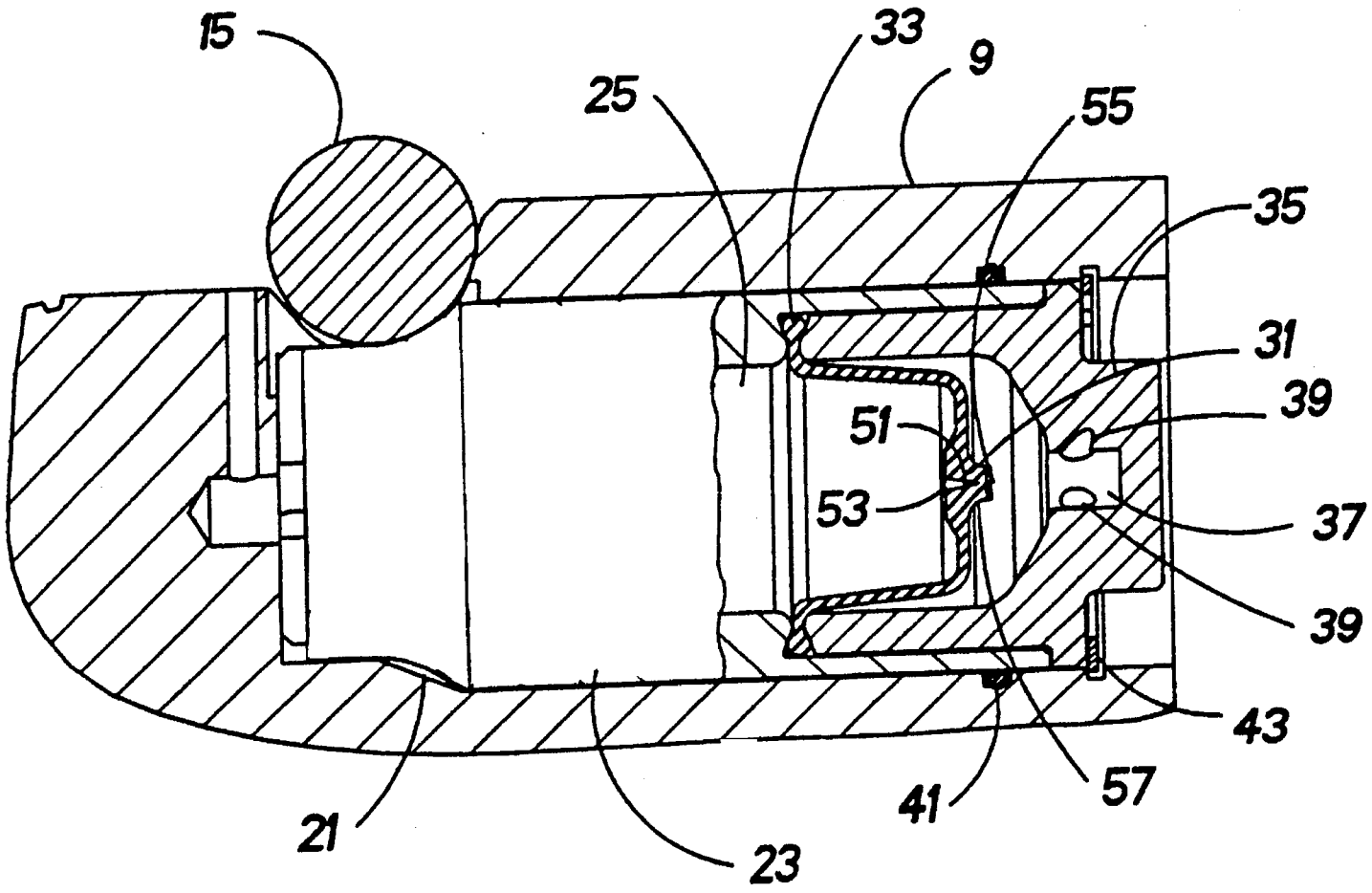
FIG. 3 is an elevation view of the end of the cutter assembly of FIG. 2.

A compensator recess 21 is formed in journal member 11 with an opening at one end thereof. A lubricant compensator assembly, which is depicted in enlarged section view in FIG. 3, is disposed in lubricant recess 21. Lubricant compensator assembly comprises a rigid ball plug member 23, which, upon assembly in journal member 11, obstructs the bearing loading passage through which spherical or ball bearing elements 15 are loaded and abuts balls 15 to retain cutter 5 on journal 11. One end of ball plug member 23 effectively becomes part of the race in which balls 15 rotate. Compensator recess 21 is necked down at its end to fully secure ball plug 25 therein. At an opposite end, ball plug 23 is hollow to define a lubricant reservoir 25. Lubricant reservoir 25 is in fluid communication with the bearing through a lubricant passage 27 and four diametral slots 29 milled in the end of ball plug 23. Another lubricant passage 30 is formed in journal 11 to insure fluid communication between reservoir 25 and the bearing.

A resilient, cup-shaped diaphragm 31 is disposed in the hollow end of ball plug 23 and encloses lubricant reservoir 25. According to the preferred embodiment of the present invention, diaphragm 31 is formed entirely of elastomeric material and includes an annular flange 33 shaped similarly to an O-ring. A rigid compensator cap 35 is disposed in compensator recess 21 and engages the hollow, open end of ball plug 23. Cap 35 cooperates with an internal shoulder in ball plug 23 to capture annular flange 33 of diaphragm 31, thereby securing and sealing diaphragm 31 to ball plug 23 without the use of adhesive bonding. Diaphragm 31 is in fluid communication with the exterior of cutter assembly 3 through a central bore 37 and three equidistantly spaced radial passages 39 in cap 35. An O-ring seal 41 is provided between ball plug 23 and lubricant compensator recess 21. Ball plug 23, diaphragm 31, and cap 35 are removably retained in lubricant compensator recess 21 by a snap ring 43, wherein the lubricant compensator assembly is readily removable.

According to the preferred embodiment of the present invention, diaphragm 31 and lubricant compensator assembly are formed substantially as disclosed in commonly assigned U.S. Pat. No. 4,727,942, Mar. 1, 1988, to Galle et al. Specifically, as shown in FIG. 3, diaphragm 31 is formed of nitrile rubber and has a perforation 51 formed in a central portion thereof. Perforation 51 takes the form of a slit that is beveled at end 53 and extends through the wall of diaphragm 31 and terminates in a recess 55 in a protuberance 57. Because the area of protuberance 57 acted on by drilling fluid is larger than the area of bevel 53 acted on by the lubricant, perforation 51 will open only when lubricant pressure exceeds hydrostatic pressure by a predetermined threshold, preferably 50 p.s.i. Moreover, cap 35 serves as a shoulder to limit expansion of diaphragm 31, thereby preventing damage to the lubricant compensator from overexpansion of diaphragm 31.

Figure 4:
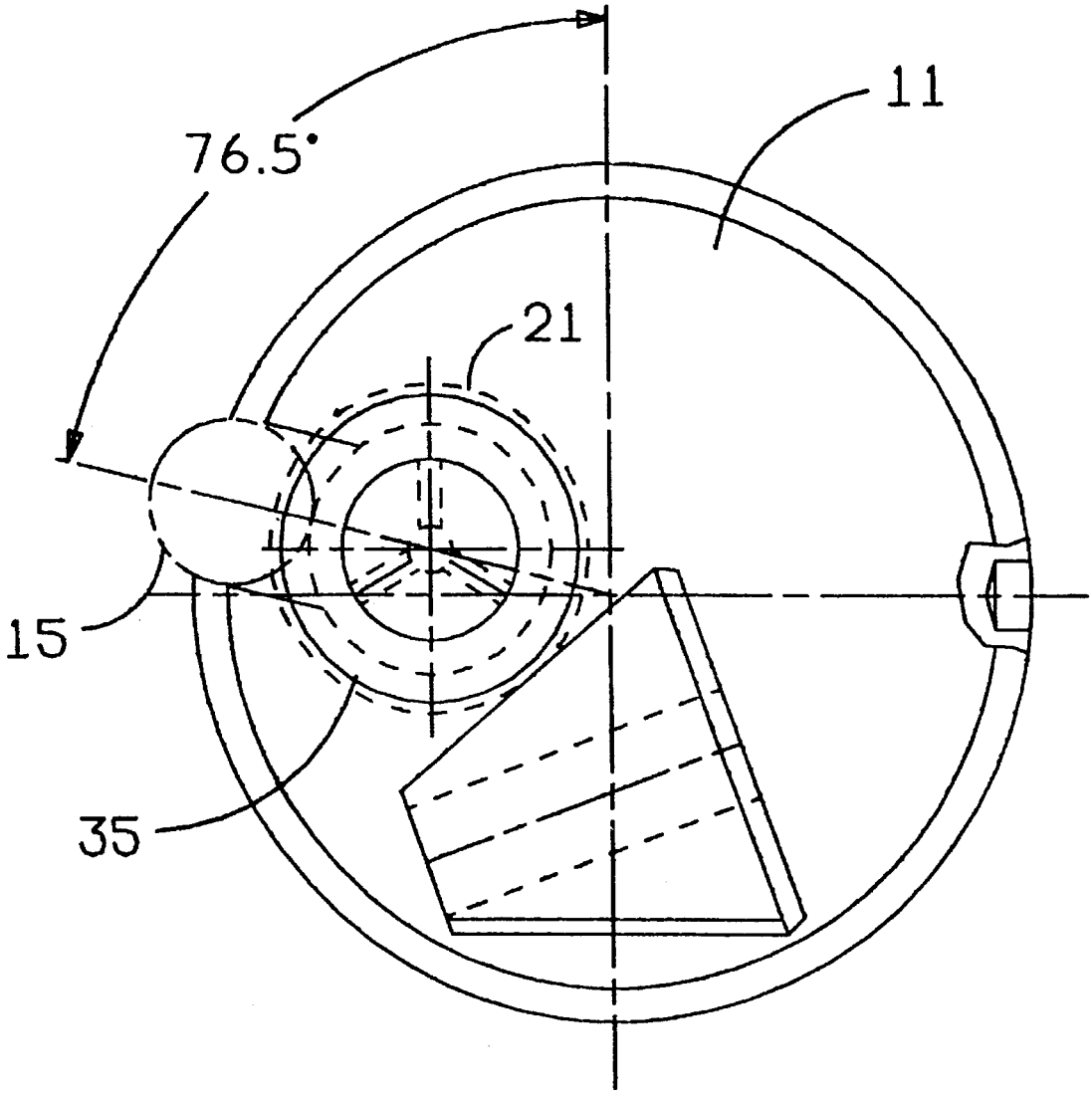
FIG. 4 is an enlarged, fragmentary section view of the lubricant compensator assembly illustrated in FIG. 2.

FIG. 4 is an end view of journal member 11 illustrating the arrangement of the lubricant compensator assembly and recess 21 within journal member 11. Journal 11 is circular in cross-section and one side of the journal (generally the upper side in FIG. 4) is nearer formation material than the bit body and is referred to as the loaded side. As can be seen in FIG. 4, the lubricant compensator and recess 21 are angularly displaced 76.5 degrees from the loaded side of journal 11. Thus, the ball loading passage (shown in phantom) is also angularly displaced 76.5 degrees from the loaded side of journal 11.

In operation, lubricant is loaded into cutter assembly 3 through lubricant passage 19 and fills the space occupied by anti-friction bearing 15, 17, the bearing loading passage, and lubricant reservoir 25 defined within the lubricant compensator assembly. As the shaft-boring bit is rotated and pushed through formation material in the presence of drilling fluid, resilient diaphragm 31 is acted upon by hydrostatic pressure in the borehole to equalize the pressure in the lubricant to that of the hydrostatic pressure.

As the lubricant temperature and internal pressure rise, resilient diaphragm 31 expands with the lubricant until the lubricant pressure exceeds the hydrostatic pressure by a predetermined threshold, at which point perforation 51 opens to vent lubricant out of reservoir 25. In the event that lubricant is not vented from reservoir 25, compensator cap 35 prevents resilient diaphragm 31 from overexpanding and rupturing or otherwise becoming distorted.

After drilling operations are ceased, the lubricant compensator assembly may be refilled and drilling continued with the same shaft-boring bit. Alternatively, if any component of the lubricant compensator assembly or bearings 15, 17 fail, the lubricant compensator assembly can be removed and replaced or repaired and access may be had to bearings 15, 17.

The shaft-boring bit according to the present invention has a number of advantages. A principal advantage is that the shaft-boring bit is provided with a lubricant compensation system or assembly that is simple and reliable and accomplishes the function of retaining ball members in the bearing, which rotatably secures the cutters on the journal members. No unreliable adhesive bonds are employed in the assembly of the lubricant compensator. Further, the lubricant compensator is provided with pressure relief means to avoid damage to the diaphragm or rigid face seals employed in the cutter assemblies thereby extending the operational life of the bit.

The shaft-boring bit according to the present invention has been described with reference to the preferred embodiment thereof. It is thus not limited, but is susceptible to variation and modification without departing from the scope and spirit of the invention.

I claim:

1. An improved earth-boring bit comprising:

a bit body;

at least one journal member having a pair of ends;

at least one saddle member secured to the bit body to receive and support each end of the journal member;

a cutter mounted for rotation on the journal member;

an anti-friction bearing disposed between the cutter and the journal member, the anti-friction bearing securing the cutter on the journal member;

seal means disposed between the cutter and the journal member to retain lubricant in the anti-friction bearing;

a bearing loading passage formed in the journal member for loading at least a portion of the anti-friction bearing between the cutter and journal member;

a lubricant compensator recess formed in one end of the journal; and a lubricant compensator assembly removably disposed in the recess and in fluid communication with the bearing, the lubricant compensator assembly including:

a rigid member partially defining a lubricant reservoir, one end of the rigid member obstructing the bearing loading passage and abutting the portion of the anti-friction bearing to retain the portion of the anti-friction bearing between the cutter and the journal; and a resilient diaphragm secured to an opposite end of the rigid member to enclose the lubricant reservoir, the diaphragm being in fluid communication with an exterior of the journal member, wherein the lubricant compensator serves to equalize a pressure differential across the seal means.

2. The earth-boring bit according to claim 1 wherein the anti-friction bearing includes a roller bearing element and a spherical element, the spherical element being loaded through the bearing loading passage and retained by the lubricant compensator.

3. The earth-boring bit according to claim 1 wherein the cutter and journal member are generally circular in cross-section and have a loaded side and a generally unloaded side, the bearing loading passage being angularly displaced approximately 76.5 degrees from the loaded side.

4. The earth-boring bit according to claim 1 wherein the seal means comprises a rigid face seal at each end of the journal member.

5. The earth-boring bit according to claim 1 wherein the diaphragm includes pressure-relief means to vent lubricant from the compensator upon pressure in the lubricant exceeding a predetermined pressure.

6. The earth-boring bit according to claim 1 further comprising:

an external flange formed on the diaphragm; and a rigid compensator cap engaging the flange of the diaphragm and the rigid member to secure the diaphragm in the compensator recess, the cap being perforated wherein the diaphragm is in fluid communication with the exterior of the journal member.

7. An improved earth-boring bit comprising:

a bit body;

at least one journal member having a pair of ends;

at least one saddle member secured to the bit body to receive and support each end of the journal member;

a cutter mounted for rotation on the journal member, the cutter and journal member having a loaded side generally opposite the bit body;

an anti-friction bearing disposed between the cutter and the journal member, the anti-friction bearing including a plurality of spherical ball elements to secure the cutter on the journal member;

seal means disposed between the cutter and the journal member to retain lubricant in the anti-friction bearing;

a ball loading passage formed transversely in the journal member for loading the ball elements between the cutter and journal member, the ball loading passage formed in a location remote from the loaded side of the journal member;

a compensator recess extending longitudinally into the journal member and intersecting the ball loading passage;

a lubricant compensator assembly disposed in the compensator recess and in fluid communication with the bearing, the lubricant compensator assembly including:

a rigid, hollow ball plug member partially defining a lubricant reservoir, one end of the ball plug member obstructing the ball loading passage and abutting the ball elements to retain the ball elements between the cutter and the journal member; and a cup-shaped resilient diaphragm secured to an opposite end of the ball plug member to enclose the lubricant reservoir, the diaphragm being in fluid communication with an exterior of the journal member, wherein the lubricant compensator serves to equalize a pressure differential across the seal means.

8. The earth-boring bit according to claim 7 wherein the cutter and journal member are generally circular in cross-section and the remote location of the ball loading passage is angularly displaced approximately 76.5 degrees from the loaded side of the journal member.

9. The earth-boring bit according to claim 7 wherein the seal means comprises a rigid face seal at each end of the cutter and journal member.

10. The earth-boring bit according to claim 7 wherein the diaphragm includes pressure-relief means to vent lubricant from the compensator upon pressure in the lubricant exceeding a predetermined pressure.

11. The earth-boring bit according to claim 7 further comprising:

an external flange formed on the diaphragm; and a rigid compensator cap engaging the flange of the diaphragm and the ball plug member to secure the diaphragm in the compensator recess, the cap being perforated wherein the diaphragm is in fluid communication with the exterior of the journal member.

12. An improved earth-boring bit comprising:

a bit body;

at least one journal member having a pair of ends;

at least one saddle member secured to the bit body to receive and support each end of the journal member;

a cutter mounted for rotation on the journal member, the cutter and journal member being generally circular in cross-section and having a loaded side generally opposite the bit body;

an anti-friction bearing disposed in a bearing race between the cutter and the journal member, the anti-friction bearing including a plurality of spherical ball elements in a ball race to secure the cutter on the journal member;

seal means disposed between the cutter and the journal member to retain lubricant in the anti-friction bearing;

a ball loading passage formed transversely in the journal member for loading the ball elements between the cutter and journal member, the ball loading passage located remotely from the loaded side of the journal member;

a compensator recess extending longitudinally into the journal member and intersecting the ball loading passage;

a lubricant compensator assembly disposed in the compensator recess and in fluid communication with the bearing, the lubricant compensator assembly including:

a rigid, hollow ball plug member partially defining a lubricant reservoir, one end of the ball plug member being radiused to form a portion of the ball race and obstructing the ball loading passage to retain the ball elements in the ball race between the cutter and the journal member;

a cup-shaped resilient diaphragm including a radial flange for engagement with an opposite end of the ball plug member to enclose the lubricant reservoir;

pressure-relief means in the diaphragm for venting lubricant from the lubricant compensator upon pressure in the lubricant exceeding a selected pressure; and a rigid compensator cap engaging the flange of the diaphragm and the ball plug member to secure the diaphragm in the compensator recess, the cap being perforated wherein the diaphragm is in fluid communication with an exterior of the journal member, wherein the lubricant compensator serves to equalize a pressure differential across the seal means.

13. The earth-boring bit according to claim 12 wherein the pressure-relief means comprises a perforated protrusion in the diaphragm at an end opposite the flange and proximal to the compensator cap, the protrusion opening to vent lubricant at the selected pressure.

14. The earth-boring bit according to claim 12 wherein the seal means is a rigid face seal.

15. An improved earth-boring bit comprising:

a bit body;

at least one journal member having a pair of ends;

at least one saddle member secured to the bit body to receive and support each end of the journal member;

a cutter mounted for rotation on the journal member;

an anti-friction bearing disposed between the cutter and the journal member, the anti-friction bearing securing the cutter on the journal member;

seal means disposed between the cutter and the journal member to retain lubricant in the anti-friction bearing;

a bearing loading passage formed in the journal member for loading at least a portion of the anti-friction bearing between the cutter and journal member;

a lubricant compensator recess formed in one end of the journal member; and a lubricant compensator assembly removably disposed in the recess and including:

a rigid, cylindrical ball plug having an open end and an interior partially defining a lubricant reservoir, one end of the ball plug obstructing the bearing loading passage and abutting the portion of the anti-friction bearing to retain the portion of the anti-friction bearing between the cutter and the journal member;

a resilient diaphragm received in the open end of the ball plug to enclose the lubricant reservoir, the diaphragm including an external flange for engagement with an internal recess in the ball plug; and a cylindrical cap received in the open end of the ball plug and engaging the flange on the diaphragm to secure the diaphragm in the ball plug, the cap having an opening to an exterior of the journal member wherein the diaphragm is in fluid communication with the exterior of the journal member and the lubricant compensator serves to equalize a pressure differential across the seal means.

16. The earth-boring bit according to claim 15 wherein the anti-friction bearing includes a roller bearing element and a spherical element, the spherical element being loaded through the bearing loading passage and retained by the lubricant compensator.

17. The earth-boring bit according to claim 15 wherein the cutter and journal member are generally circular in cross-section and have a loaded side and a generally unloaded side, the bearing loading passage being formed remotely from the loaded side.

18. The earth-boring bit according to claim 15 wherein the seal means comprises a rigid face seal at each end of the journal member.

19. The earth-boring bit according to claim 15 wherein the diaphragm includes pressure-relief means to vent lubricant from the compensator upon pressure in the lubricant exceeding a predetermined pressure.

* * * * *